United States Patent [19]

Kaifuchi

[11] 4,302,302

[45] Nov. 24, 1981

[54] METHOD OF FEEDING ALUMINA TO AN ALUMINIUM ELECTROLYTIC CELL AND APPARATUS THEREFOR

[75] Inventor: Toshiaki Kaifuchi, Joetsu, Japan

[73] Assignee: Mitsubishi Light Metal Ind., Ltd., Tokyo, Japan

[21] Appl. No.: 148,381

[22] Filed: May 9, 1980

[51] Int. Cl.[3] ..... C25C 3/06; C25C 3/14

[52] U.S. Cl. ..... 204/67; 204/245

[58] Field of Search ..... 204/67, 243 R, 245

[56] References Cited

U.S. PATENT DOCUMENTS 3,919,058 11/1975 Waenerlund ..... 204/67

*Primary Examiner*—Howard S. Williams

*Attorney, Agent, or Firm*—Oblon, Fisher, Spivak, McClelland & Maier

[57] ABSTRACT

A method of feeding alumina to a Söderberg type aluminium electrolytic cell characterized by forming a box body having an opening in the upper part and an opened lower end on the side of the anode of said electrolytic cell with an anode casing, a dam plate located outside said cathode casing and above a freeze of said electrolytic cell and two side plates covering spaces between said anode casing and said dam plate, charging alumina from said opening so that said alumina is stored in said box body and simultaneously flows out from the lower end of said dam plate to accumulate on said freeze, forming a slope in response to its angle of repose, and thereby, when said freeze is broken, the accumulated alumina is charged into the electrolytic bath of said electrolytic cell and simultaneously the alumina stored in said box body flows out spontaneously to form a new slope of accumulated alumina, and an apparatus for the same.

2 Claims, 2 Drawing Figures

METHOD OF FEEDING ALUMINA TO AN ALUMINIUM ELECTROLYTIC CELL AND APPARATUS THEREFOR

BACKGROUND OF THE INVENTION

1. Field of the Invention

The present invention relates to a method of feeding alumina and an apparatus therefor. More particularly, the present invention relates to an automatic feeding of alumina onto a freeze in Söderberg type aluminium electrolytic cell.

2. Description of the Prior Art

When feeding alumina into a Söderberg type aluminium electrolytic cell, a method of feeding alumina directly onto a freeze formed surrounding an anode from a moving type of alumina supplier provided outside the electrolytic cell has hitherto been used. FIG. 1 is a vertical section showing schematically a state of the electrolytic cell being operated by such method. In the figure, (1) is an anode, (2) is an anode casing, (3) is a H-figure beam for preventing the expansion of the anode, (4) is a gas collecting hood, (5) is an electrolytic bath, (6) is a molten metal, (7) is a cathode block, (8) is a freeze, (9) is alumina, (10) is a grand ramming paste, (11) is a working stand, (12) is a fin of the H-figure beam, (13) is an outer casing of cathode cell, and (14) is a cathode lining comprising firebricks and/or side carbons. Alumina is supplied onto the freeze (8) by a moving type of alumina supplier (not shown in drawing) provided outside of the electrolytic cell and accumulates there. The alumina (9) on the freeze (8) is charged into the eletrolytic bath (5) by breaking the freeze (8) using a freeze breaking means (not shown in drawing) periodically or in response to a signal indicating the lowering of alumina concentration in the electrolytic bath.

In the operation of the aluminium electrolytic cell an optimum value exists in the alumina concentration in the electrolytic bath, and, therefore, if the alumina concentration can be maintained within a certain narrow range, it can be connected to the improvement of current efficiency and the drop of cell voltage. The alumina concentration in the electrolytic bath increases temporarily by charging of alumina into the bath by breaking of the freeze and thereafter decreases almost linearly till the next breaking of the freeze. The increase in the alumina concentration at the time of breaking the freeze depends on the thickness of alumina layer accumulated on the freeze if the area of freeze broken is maintained constant, and, therefore, it is determined by the amount of alumina supplied at a time by the alumina supplier. Accordingly, in order to lessen the fluctuation of alumina concentration in the electrolytic bath it is necessary to reduce the amount of alumina supplied at a time as much as possible and to carry out the supply of alumina and breaking of freeze at short time intervals.

However, in the above described conventional alumina feeding method, there are limits to the reduction of the time intervals of supplying alumina since the feeding of alumina to multiple electrolytic cells is carried out by one alumina supplier provided outside of the electrolytic cells. And it is considerably difficult to distribute alumina uniformly onto the freeze, and it is inevitable that the amount of alumina charged into the bath at the time of breaking of the freeze becomes considerably random.

As the result of studies aimed at solving the defects in the above described conventional methods and providing an improved method of feeding alumina in which the prescribed amount of alumina can be always fed automatically onto the freeze and an apparatus therefor, the present inventor has found that alumina can be preferably fed by forming a specific shape of box body on the side of anode in the Söderberg type aluminium electrolytic cell and has accomplished the present invention.

SUMMARY OF THE INVENTION

An object of the present invention is to solve the defects of the above described conventional method and provide an improved method of feeding alumina in which the prescribed amount of alumina can be always fed automatically onto the freeze and an apparatus therefor.

Another object of the present invention is to provide an improved method of feeding alumina in which alumina can be delicately fed to the electrolytic bath at short time intervals without restriction by the feeding capacity of an alumina supplier equipped outside of the electrolytic cell.

According to the present invention, a method of feeding alumina to a Söderberg type aluminium electrolytic cell is characterized by forming a box body having an opening in the upper part and an opened lower end on the side of the anode of said electrolytic cell with an anode casing, a dam plate located outside said anode casing and above a freezer of said electrolytic cell and two side plates covering spaces between said anode casing and said dam plate, charging alumina from said opening so that said alumina is stored in said box body and simultaneously flows out from the lower end of said dam plate to accumulate on said freeze, forming a slope in response to its angle of repose, and thereby, when said freeze is broken, the accumulated alumina is charged into the electrolytic bath of said electrolytic cell and simultaneously the alumina stored in said box body flows out spontaneously to form a new slope of accumulated alumina, is provided.

And also, according to the present invention, an apparatus for carrying out the above described method of feeding alumina, which is charaterized by comprising a box body having an opening in the upper part and an opened lower end with the sides of said box body being formed by an anode casing of Söderberg type aluminium electrolytic cell, a dam plate provided outside said anode casing and above a freeze of said electrolytic cell and two side plates covering spaces between said anode casing and said dam plate, and constituted so that alumina flowing out from the lower end of said dam plate may form a slope in response to its angle of repose and the utmost end of said slope may not be over the upper end of outer casing of cathode cell, is provided.

DETAILED DESCRIPTION OF THE INVENTION

Figure 1:
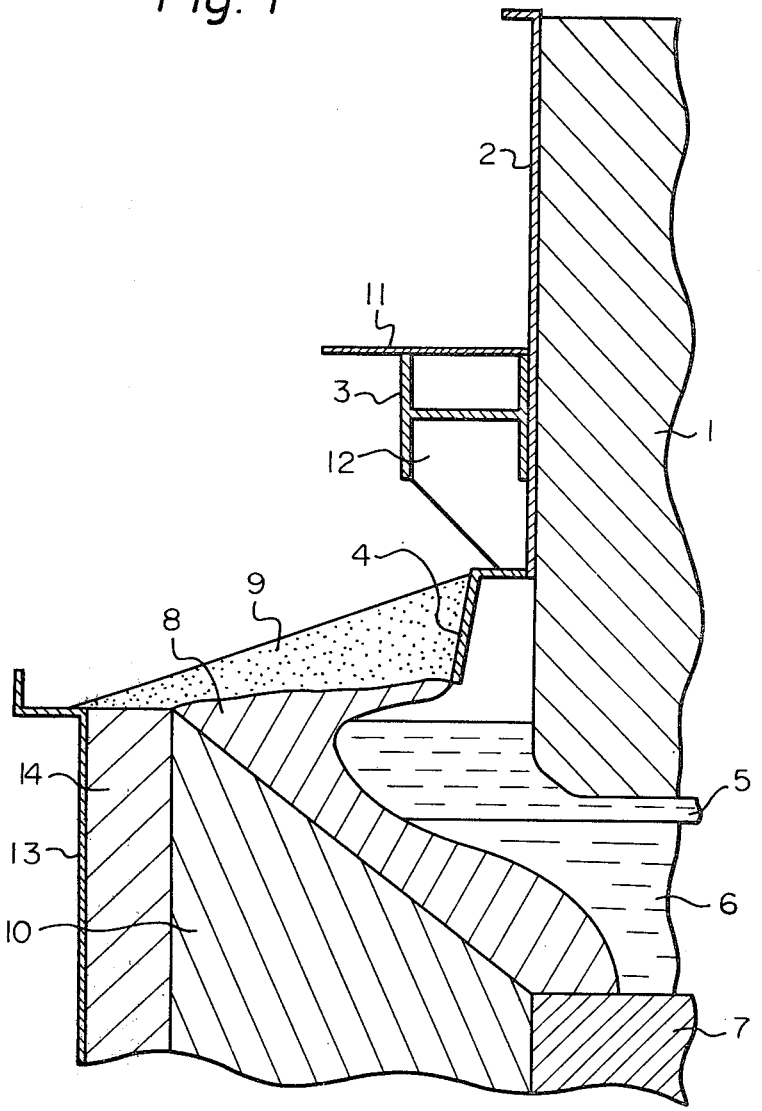
FIG. 1 is a vertical section showing schematically a state of the aluminium electrolytic cell being operated by the conventional method.
Figure 2:
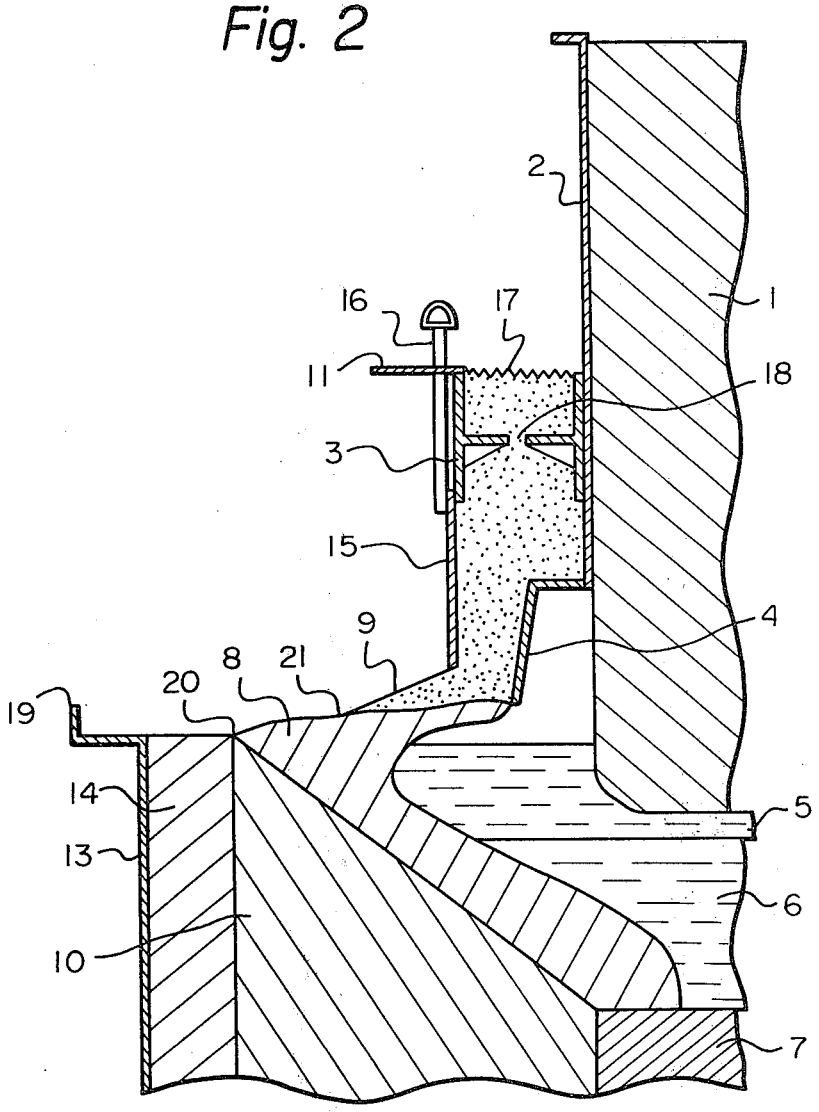
FIG. 2 is a vertical section showing schematically a state of the aluminium electrolytic cell being operated attached with the alumina feeding apparatus according to the present invention.

The present invention will be explained more in detail referring to a drawing showing an embodiment of the alumina feeding apparatus of the present invention. FIG. 2 is a vertical section showing schematically an operating state of the electrolytic cell with the alumina feeding apparatus, in which (1) to (11) and (13) and (14) are the same as in FIG. 1. A dam plate (15) is provided at a space from the anode casing (2) in a position outside of the anode casing and above the freeze (8).

In this embodiment, the dam plate (15) is provided on the outer side of the H-figure beam (3) and is constituted in such a manner that it can be ascended and descended by a dam plate suspending rod (16). The working stand (11) is provided with an opening (17) for feeding alumina and set up with expanding metal or an appropriate metal grid for maintaining the function of working stand. An opening (18) is provided in the central part of H-figure beam so as to permit passage through the upper and lower parts. In this case the opening (18) is to be suitable in size so that the strength of H-figure beam is not remarkably weakened but the feeding of alumina is not difficult. The both sides of the space between the anode casing (2) and the dam plate (15) are covered by side plates (not shown in drawing). Thus, the anode casing (2), the dam plate (15) and the two side plates form a box body which is opened in top and bottom. The upper end of this box body is covered by the working stand (11) having the opening (17). The dam plate (15) is constituted in such a manner that alumina flowing out from the lower end forms a slope in response to the angle of repose and the far end (21) of the slope does not go across the upper end (19) of the outer casing (13) of the cathode cell. That is, the dam plate (15) can be let down to such a position that the angle of a plane passing the lower edge of the dam plate and the upper end (19) of the outer casing (13) of the cathode cell to the horizontal plane is smaller than the angle of repose of alumina. The angle of repose is generally within the range of 30° to 40° although it is not always fixed since it varies with its particle size, water content and etc., and the value of the angle can be known by a simple measurement on alumina used as a raw material.

The method of feeding alumina by the above described apparatus will be explained. Alumina is charged through the opening (17) by an appropriate external alumina supplier, passes through the opening (18) to reach on the freeze (8) and fills up the above described box body and simultaneously flows out from the lower edge of the dam plate (15) to form a slope in response to the angle of repose and rests on the freeze (8). The position of the far end (21) of the slope formed by alumina (9) flowing out from the lower end of the dam plate (15) is not particularly limited if it is within such a range that alumina does not run over the upper end (19) of the outer casing (13) of cathode cell and it may be on the freeze (8) or on the cathode lining (14). In case the slope of alumina covers the upper surface of the cathode lining (14) even partially, it is effective for preventing the heat radiation therefrom.

Further, in case alumina flows out in such a manner that the slope of alumina covers the upper surface of the cathode lining (14) completely and the far end (21) protrudes to the upper part of the outer casing (13) of cathode cell, an effect of preventing the heat radiation from the upper surface of the cathode lining (14) increases. However, in this case, the amount of alumina charged into the electrolytic bath by one breaking of freeze increases since the layer of alumina accumulated on the freeze becomes thicker. Therefore, in some methods of breaking the freeze, it is sometimes feared that the control of alumina concentration in electrolytic bath becomes difficult or that the excess feeding of alumina is caused. Conversely, in case alumina flows out in such a manner that the far end (21) of alumina slope stays on the freeze, the amount of alumina charged into the electrolytic bath by one breaking of freeze decreases since the layer of alumina accumulated on the freeze becomes thinner, although the heat radiation from the upper surface of the cathode lining cannot be prevented. Therefore, the delicate control of alumina concentration in the bath becomes easier. On the other hand, in case of the same accumulation condition of alumina, the amount of alumina charged into the bath by the breaking of freeze depends also on the breaking method of freeze, and can be controlled to some extent thereby. Therefore, the area of alumina slope, that is the position of the far end (21), is determined to the most preferable position on the basis of the concrete mutual relation of the necessity for preventing the heat radiation from the upper surface of cathode lining and advantage obtained thereby, the permitted range in the amount of alumina charged into the electrolytic bath, the breaking method of freeze and the possibility of control thereby, and others.

In the present invention, alumina in an amount corresponding to from several times to ten and several times the breaking of freeze (charge of alumina into the bath) can be stored within the box body by making it sufficient size. When breaking the freeze by an appropriate freeze breaking means (not shown in drawing), alumina which has flowed out and accumulated on the freeze is charged into the bath and simultaneously alumina stored within the box body flows out spontaneously to form a new layer of accumulated alumina for the next breaking of freeze. The thickness of the layer of accumulated alumina depends upon the position of the far end (21) of the slope of alumina flowing out from the box body, as described above, and decides the amount of alumina charged into the bath accompanying one breaking of freeze. The thickness can be easily changed by moving the dam plate suspending rod (16) to raise and lower the dam plate (15) and thereby changing the space between the lower end of the dam plate and the freeze (8).

The alumina feeding apparatus of the present invention is not limited to the above described specific embodiment. The dam plate (15) is provided at a side of the anode (1), where the feeding of alumina (i.e. breaking of freeze) is carried out. On each side, one sheet of dam plate may be provided over the total length thereof, or plural dam plates may be continuously or intermittently provided.

In the latter case, plural independent alumina feeding apparatuses are provided on one side of the anode (1) and since the amount of alumina fed from each feeding apparatus can be independently controlled it becomes possible to carry out the alumina feeding more delicately. And although, in the above described specific embodiment, the dam plate (15) is provided on the outer side of the H-figure beam (3), the method of providing the dam plate is not limited thereto, and such an appropriate method as supporting it by the anode structure or supporting it by an independent support or frame can be adopted in response to the structure of the object electrolytic cell. Further, the side plate is not necessarily provided independently from the dam plate, and, if the structure of the electrolytic cell allows, also such a construction as having installed a J-type of side forming member in which the dam plate and the side plates are integrated to the outside of the anode casing can be adopted. In the case of providing a dam plate attached to the anode casing, a mechanism of raising and dropping the dam plate is needed since it rises and falls with the anode casing and the amount of alumina fed is changed thereby, but, in case of providing the dam plate independently from the anode, such mechanism of raising and dropping the dam plate is not necessary. However, also in this case, an ascent and descent mechanism is preferably provided to the dam plate so that the amount of alumina fed can be controlled.

According to the alumina feeding method and the apparatus therefor of the present invention, alumina can be delicately fed to an electrolytic bath without subjecting to restriction by the feeding capacity of alumina supplier provided outside of the electrolytic cell since the prescribed amount of alumina can be always fed automatically onto the freeze from the box body having stored alumina in an amount corresponding to many numbers of times of breaking of freeze. Therefore, the alumina concentration in the bath can be maintained within a certain range near the optimum value and the improvement of current efficiency and the lowering of cell voltage can be accomplished.

And, in the apparatus of the present invention, since the number of times of feeding alumina to the electrolytic cell by an external alumina supplier can be largely decreased and power is not required for the feeding of alumina onto the freeze, the whole power and labor required for alumina feeding can be reduced. And, since alumina fed onto the freeze can be sufficiently preheated because a large amount of alumina is stored on the outside of anode casing and alumina covering the outside of anode casing and gas collecting hood has a heat insulating effect, the heat loss in the electrolytic cell can be reduced and the energy consumption can be improved with a combination of the both.

Further, the time for which the electrolytic bath is exposed can be shortened and the diffusion of volatile component from the electrolytic bath can be reduced since, immediately after the breaking of freeze, alumina flows out spontaneously to form a layer of alumina accumulated.

Next, the present invention will be more concretely explained with an Example but the present invention is not intended to be limited by the Example unless it covers the gist of the present invention.

EXAMPLE

In a vertical stud Söderberg type rectangular aluminium electrolytic cell of 105 KA in cell current, an alumina feeding apparatus having a shape as shown in FIG. 2 and holding about 500 Kg of alumina in one side and about 1000 Kg in both sides was provided over the total length of anode casing of the both sides of the cell and an electrolytic operation was performed.

The average position of the lower end of dam plate (15) was about 160 mm in height from the horizontal plane passing the upper end (20) of cathode cavity, although the dam plate was sometimes moved up and down in response to the state of cell such as the frequency of anode effect, the fluctuation of the position of freeze, and others for the purpose of controlling the amount of alumina to be fed into the electrolytic bath.

Heretofore, whenever the freeze is broken to feed alumina into the electrolytic bath, immediately thereafter alumina has to be supplied onto the freeze by means of a moving type of alumina supplier provided in the external of the cell in order to prevent the running away of the volatile components and heat in the electrolytic bath from broken places, however, when using the above described alumina feeding apparatus, there is no necessity for supplying alumina from the outside of the electrolytic cell until feeding of alumina to the electrolytic bath is carried out three to five times, and thus the operation efficiency could be steeply improved.

Further the heat loss of the electrolytic cell could be reduced by about 15 KW in average since alumina is preheated by absorbing heat radiated from the lower part of anode casing and the gas collecting hood while the alumina is held in the above described alumina feeding apparatus till it is charged into the electrolytic bath. As the result, the energy consumption could be improved by about 500 KWH/t-Al.

And also, since the amount of alumina on the freeze can be always maintained almost constant because alumina is automatically fed by spontaneously flowing down by the above described alumina feeding apparatus, it has becomes possible to optimize the time interval of alumina feeding to the electrolytic bath and, therefore, it could be operated while maintaining the alumina concentration in the electrolytic bath near the more optimum value of the electrolytic cell.

What is claimed is:

1. A method of feeding alumina to a Söderberg type aluminum electrolytic cell having a cathode cell including an alumina freeze, comprising the steps of:

forming, on the side of the anode casing of the anode of said electrolytic cell, a box body having an opening in the upper part thereof and an open lower end, a vertically adjustable dam plate spaced outwardly from said anode casing and adapted to be above the alumina freeze, and side plates extending between said anode casing and said dam plate;

supplying alumina to said box body so that said alumina flows from said box body and said dam plate and accumulates on said freeze with a surface whose slope is determined by the angle of repose of said alumina;

adjusting the vertical position of said dam plate to a predetermined height; and breaking said freeze whereby a predetermined quantity of alumina is charged into said electrolytic cell and is replaced by alumina from said box body.

2. An apparatus for feeding alumina to a Söderberg type aluminium electrolytic cell having a cathode cell casing and an anode casing, said apparatus comprising a box body having an opening in the upper part and an open lower end, with the sides of said box body formed by said anode casing of said electrolytic cell, by a dam plate provided outside said anode casing and adapted to be above a freeze of said electrolytic cell, said dam plate supported so as to be movable up and down, and by two side plates covering spaces between said anode casing and said dam plate, whereby alumina flowing out from the lower end of said dam plate forms a slope in respose to its angle of repose and the far end of said slope is not over the upper end of said casing of the cathode cell.

* * * * *